US005431383A

United States Patent [19]

Fujimoto et al.

[11] Patent Number: 5,431,383

[45] Date of Patent: Jul. 11, 1995

[54] CUT SHEET FEEDER FOR IMAGE FORMING APPARATUS

[75] Inventors: Yasuhiro Fujimoto, Iruma; Susumu Oshio, Ushiku; Kosai Adachi, Tsukuba, all of Japan

[73] Assignee: Riso Kagaku Corporation, Tokyo, Japan

[21] Appl. No.: 213,008

[22] Filed: Mar. 15, 1994

[30] Foreign Application Priority Data

Mar. 16, 1993 [JP] Japan ..... 5-056030
Mar. 16, 1993 [JP] Japan ..... 5-056037

[51] Int. Cl.[6] ..... B65H 3/44
[52] U.S. Cl. ..... 271/9.06; 271/157
[58] Field of Search ..... 271/9, 152, 157, 158, 271/147, 162

[56] References Cited

U.S. PATENT DOCUMENTS 4,332,375 6/1982 Tsubo ..... 271/157 X
5,335,901 8/1994 Nonomura et al. ..... 271/155 X

FOREIGN PATENT DOCUMENTS 117722 1/1989 Japan ..... 271/157
122733 1/1989 Japan ..... 271/157

*Primary Examiner*—David H. Bollinger
*Attorney, Agent, or Firm*—Kanesaka & Takeuchi

[57] ABSTRACT

A cut sheet feeder for use with an image forming apparatus includes a sheet feed mechanism and a sheet feed unit mechanism. The sheet feed mechanism picks up stacked cut sheets one at a time from a predetermined position and feeds each sheet to an image recording portion. The sheet feed unit is vertically movable relative to the sheet feed mechanism and has a first sheet feed table. The first sheet feed table is located in an upper part of the sheet feed unit and includes a cutout portion for avoiding interference with the sheet feed mechanism when the first sheet feed table moves vertically in combination with the sheet feed unit. A second sheet feed table is located in a lower part of the sheet feed unit and vertically movable relative to the sheet feed unit.

6 Claims, 8 Drawing Sheets

CUT SHEET FEEDER FOR IMAGE FORMING APPARATUS

BACKGROUND OF THE INVENTION

1. Field of the Invention

The present invention relates to a cut sheet feeder for use with the image forming apparatus such as a copier or a printer, the feeder feeding the apparatus with cut sheets of recording paper.

2. Description of the Related Art

The image forming apparatus is most often used to record images on a large number of cut sheets of the same size which are fed continuously (e.g., from a sheet feed table for bulk printing). But occasionally, it is desired to interrupt the ongoing process of image printing involving many cut sheets so as to insert image printing of a different kind typically on a smaller number of sheets (fed typically from a cassette). Some of the conventional cut sheet feeders for use with the image forming apparatus have mechanisms that meet the requirements for the on-demand inserted printing.

FIGS. 8(*a*) and 8(*b*) are perspective views showing a conventional image forming apparatus equipped with a cut sheet feeder capable of feeding sheets either from a sheet feed table or from a cassette. In the figures, the cut sheet feeder 91 is attached to one side of the image forming apparatus 90. The cut sheet feeder 91 comprises a frame 92 mounted retractably from the feeder body 91*a*, pick-up rollers 93 attached to a top side of the frame 92, a sheet feed table 95 which moves up and down inside the frame 92 and which has a large number of cut sheets 94 stacked thereon, and a sheet guide 96 adjustable in the longitudinal direction of the cut sheets 94 on the sheet feed table 95. Distinct from the cut sheet feeder 91, cassettes 97 are mounted removably in the image forming apparatus 90. They have different sizes that correspond to the sizes of cut sheets.

The above type of conventional cut sheet feeder has a plurality of sheet feed mechanisms positioned near the sheet feed table 95 and the cassettes 97, each mechanism comprising its dedicated pick-up rollers (only the rollers for the sheet feed table are shown), guide plates and other related parts. When an operator selects a desired sheet type, the corresponding sheet feed mechanism is activated. The activated mechanism picks up cut sheets one by one from the sheet feed table 95 or from the corresponding sheet cassette 97 and feeds them into a predetermined position inside the image forming apparatus 90.

The conventional cut sheet feeder of the above-mentioned type has as many sheet feed mechanisms as the number of the sheet feed table 95 and the sheet cassettes 97 that are mounted in advance of feed operation. The cut sheet feeder also has a plurality of sheet transport routes for guiding cut sheets from the multiple storage locations via rollers to a common feed position. These features make the cut sheet feeder bulky, complex, and thus prone to feed-related troubles.

SUMMARY OF THE INVENTION

It is a first object of the present invention to provide a small, simply structured cut sheet feeder allowing any one of different sizes of cut sheets to be selected as desired for feed operation.

In trying to achieve the first object, the inventor of this invention came up with a cut sheet feeder having a single sheet feed mechanism to which any one of a plurality of sheet feed tables carrying many cut sheets or of sheet cassettes containing different sizes of cut sheets is positioned as desired.

But because the cut sheet feeder of the above type requires one of its sheet feed tables or sheet cassettes to be moved to a single sheet feed position, arrangements need to be made so that one table or cassette will not interfere during movement with any other table or cassette.

With the sheet cassettes made detachable, the procedure of on-demand inserted printing is made simpler. But there are still measures to be taken to provide a sufficient space to accommodate the cassettes and means to select any one of the cassettes depending on the desired size of cut sheets so as to place the cassettes on their respective accommodating plates.

It is therefore a second object of the present invention to provide a small, simply structured cut sheet feeder which permits the selection of either cassette-based or sheet feed table-based operation as desired; which ensures a sufficient cassette accommodating space; which allows any one of the cassettes to be selected depending on the desired size of cut sheets; and which lets the operator readily switch different sizes of cut sheets on the sheet feed table for bulk printing.

In achieving the foregoing and other objects of the present invention and according to a first aspect thereof, there is provided a cut sheet feeder for use with an image forming apparatus, comprising: a sheet feed mechanism for picking up stacked cut sheets one at a time from a predetermined position and for feeding each sheet to an image recording portion; a sheet feed unit vertically movable relative to the sheet feed mechanism; a first sheet feed table located in an upper part of the sheet feed unit and including a cutout portion for avoiding interference with the sheet feed mechanism when the first sheet feed table moves vertically in combination with the sheet feed unit; and a second sheet feed table located in a lower part of the sheet feed unit and vertically movable relative to the sheet feed unit.

According to a second aspect of the invention, there is provided a cut sheet feeder for use with an image forming apparatus, comprising: a sheet feed mechanism for picking up stacked cut sheets one at a time from a predetermined position and for feeding each sheet to an image recording portion; a sheet feed unit vertically movable relative to the sheet feed mechanism; a cassette plate which is located in an upper part of the sheet feed unit, which includes a cutout portion for avoiding interference with the sheet feed mechanism when moving vertically in combination with the sheet feed unit, and which accommodates detachably a cassette containing cut sheets; and a sheet feed table which is located in a lower part of the sheet feed unit, which is vertically movable relative to the sheet feed unit, and which accommodates more cut sheets than the cassette.

With the structure according to the second aspect of the invention, cassette-based sheet feed operation proceeds as follows: the vertically movable sheet feed unit is set so that the cassette plate will be positioned under the sheet feed mechanism. The cassette is mounted on the cassette plate in the upper part of the sheet feed unit. The sheet feed mechanism then feeds cut sheets from the cassette into the image forming apparatus.

For sheet feed table-based feed operation, the cassette is removed and the sheet feed unit is lifted to position the cassette plate above the sheet feed mechanism.

While the sheet feed unit is being lifted, the sheet feed mechanism passes through the cutout portion of the cassette plate so that there is no interference with the sheet feed unit. The sheet feed mechanism then feeds cut sheets from the sheet feed table into the image forming apparatus.

In a preferred structure according to the invention, there is provided a cut sheet feeder for use with an image forming apparatus, wherein the position of the sheet feed table is horizontally adjustable.

In a further preferred structure according to the invention, there is provided a cut sheet feeder comprising: an operation part disposed on said sheet feed unit, the operation part being used to adjust the horizontal position of the sheet feed table; a cover employed to cover the operation part when cut sheets are fed from the cassette plate and to expose the operation part when cut sheets are fed from the sheet feed table.

According to a third aspect of the invention, there is provided a cut sheet feeder for use with an image forming apparatus, comprising: a sheet feed mechanism for picking up stacked cut sheets one at a time from a predetermined position and for feeding each sheet to an image recording portion; a sheet feed unit vertically movable relative to the sheet feed mechanism; a first sheet feed table located in an upper part of the sheet feed unit and including a cutout portion for avoiding interference with the sheet feed mechanism when the first sheet feed table moves vertically in combination with the sheet feed unit; a second sheet feed table located under the first sheet feed table and vertically movable within the sheet feed unit; and a pair of fences furnished inside the sheet feed unit for aligning the edge positions of the cut sheets placed on the second sheet feed table.

According to a fourth aspect of the invention, there is provided a cut sheet feeder for use with an image forming apparatus, comprising: a sheet feed mechanism for picking up stacked cut sheets one at a time from a predetermined position and for feeding each sheet to an image recording portion; a sheet feed unit which is vertically movable; a first sheet feed table which is located in an upper part of the sheet feed unit, which includes a cutout portion for avoiding interference with the sheet feed mechanism when moving vertically in combination with the sheet feed unit relative to the sheet feed mechanism, which accommodates detachably and on top thereof a cassette containing cut sheets; a second sheet feed table which is located under the first sheet feed table, which is vertically movable inside the sheet feed unit, and which accommodates cut sheets on top thereof; and a pair of fences adjustably attached to said sheet feed unit depending on the size of the cut sheets placed on the second sheet feed table, the fences aligning the edge positions of the cut sheets.

With the structure according to the third or the fourth aspect of the invention, cassette-based sheet feed operation proceeds as follows: the vertically movable sheet feed unit is set so that the cassette plate will be positioned under the sheet feed mechanism. The sheet feed unit is then set so that the first sheet feed table in the upper part of the sheet feed unit will be positioned under the sheet feed mechanism. The cassette is mounted on the first sheet feed table. After this, the sheet feed mechanism feeds cut sheets from the cassette into the image forming apparatus.

For sheet feed table-based feed operation, the cassette is removed and the sheet feed unit is lifted to position the first sheet feed table above the sheet feed mechanism. While the sheet feed unit is being lifted, the sheet feed mechanism passes through the cutout portion of the first sheet feed table and there occurs no interference with the sheet feed unit. The sheet feed mechanism then feeds cut sheets from the second sheet feed table into the image forming apparatus.

When replacing the cut sheets currently placed on the second sheet feed table with those of another size, the operator removes the current sheets, places cut sheets of the desired size onto the second sheet feed table, and moves the two fences to align the edge positions of the newly placed sheets. Because the fences are furnished inside the sheet feed unit, the procedure of changeover from the second sheet feed table to the cassette for feed operation does not entail interference between the fences and the cassette being handled. It is possible to provide an ample space for setting up the cassette in place.

These and other objects, features and advantages of the invention will become more apparent upon a reading of the following description and appended drawings.

BRIEF DESCRIPTION OF THE DRAWINGS

FIG. 7(*b*) is a schematic view of the embodiment set for sheet feed operation from the cassette;

FIG. 8(*b*) is a perspective view of the conventional cut sheet feeder with its frame drawn out of the feeder body.

DESCRIPTION OF THE PREFERRED EMBODIMENT

Figure 1:
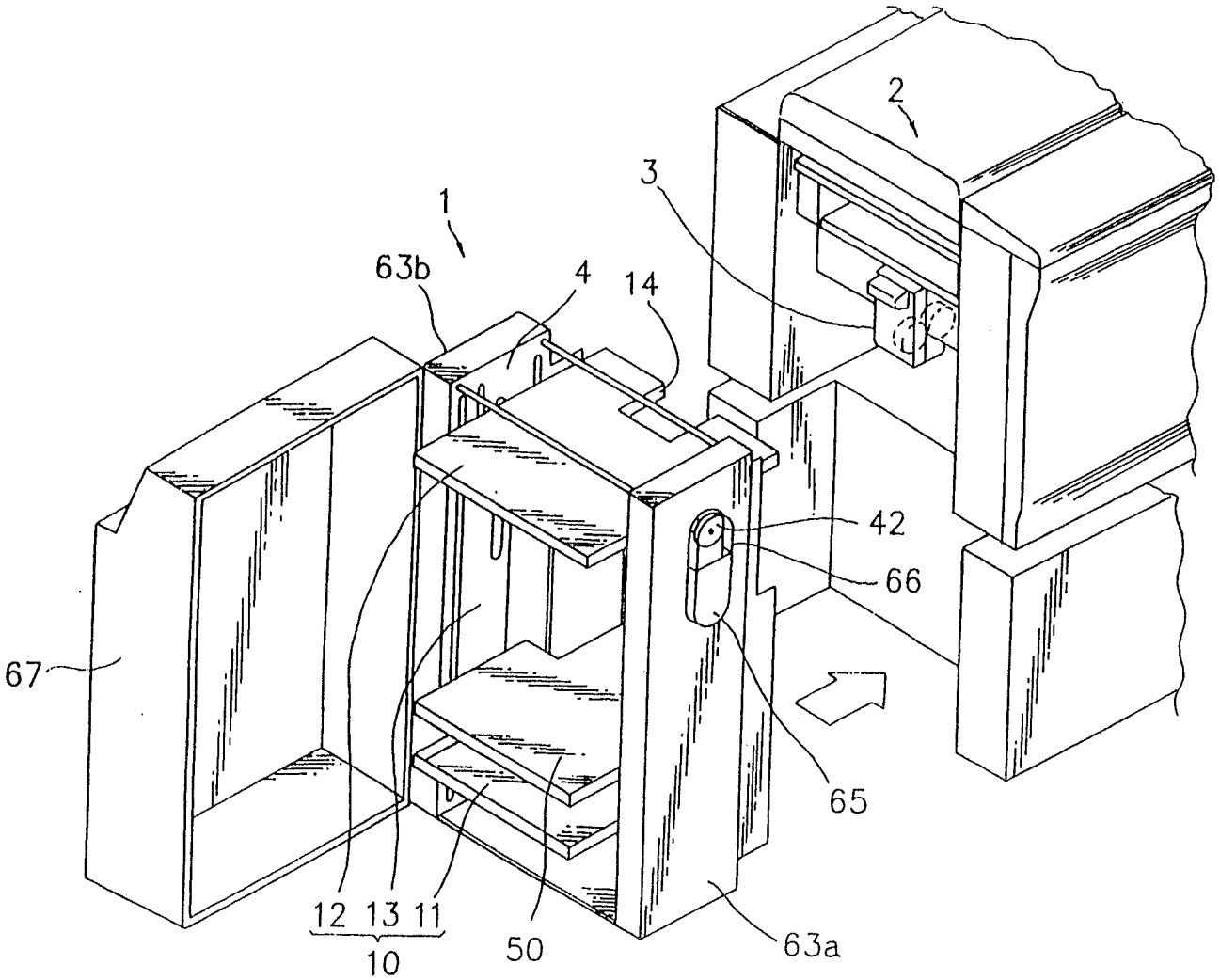
FIG. 1 is a perspective view of a cut sheet feeder in combination with a printing machine, the cut sheet feeder embodying the invention.

A cut sheet feeder 1 shown in FIG. 1 is one preferred embodiment of the invention incorporated in a mimeograph printing machine 2. A sheet feed mechanism 3 furnished on the side of the printing machine 2 includes pick-up rollers for taking in cut sheets from the cut sheet feeder 1. The cut sheet feeder 1 positions to the sheet feed mechanism 3 either a cassette containing cut sheets or a sheet feed table carrying cut sheets stacked thereon. The cassette or the sheet feed table is moved up and down before coming into a position to feed the printing machine 2 with necessary cut sheets.

Figure 2:
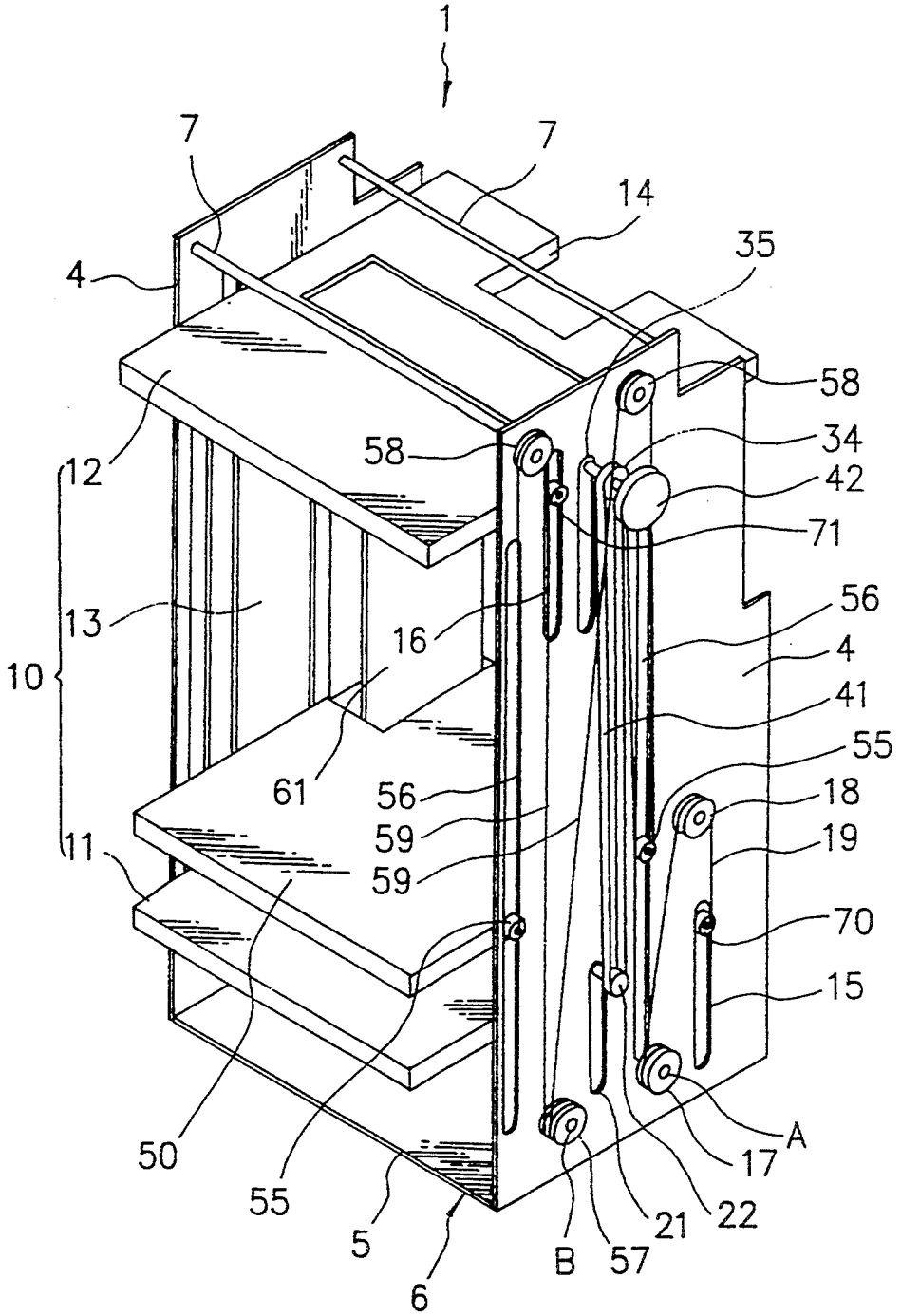
FIG. 2 is a perspective view of major driving components of the embodiment.
Figure 3:
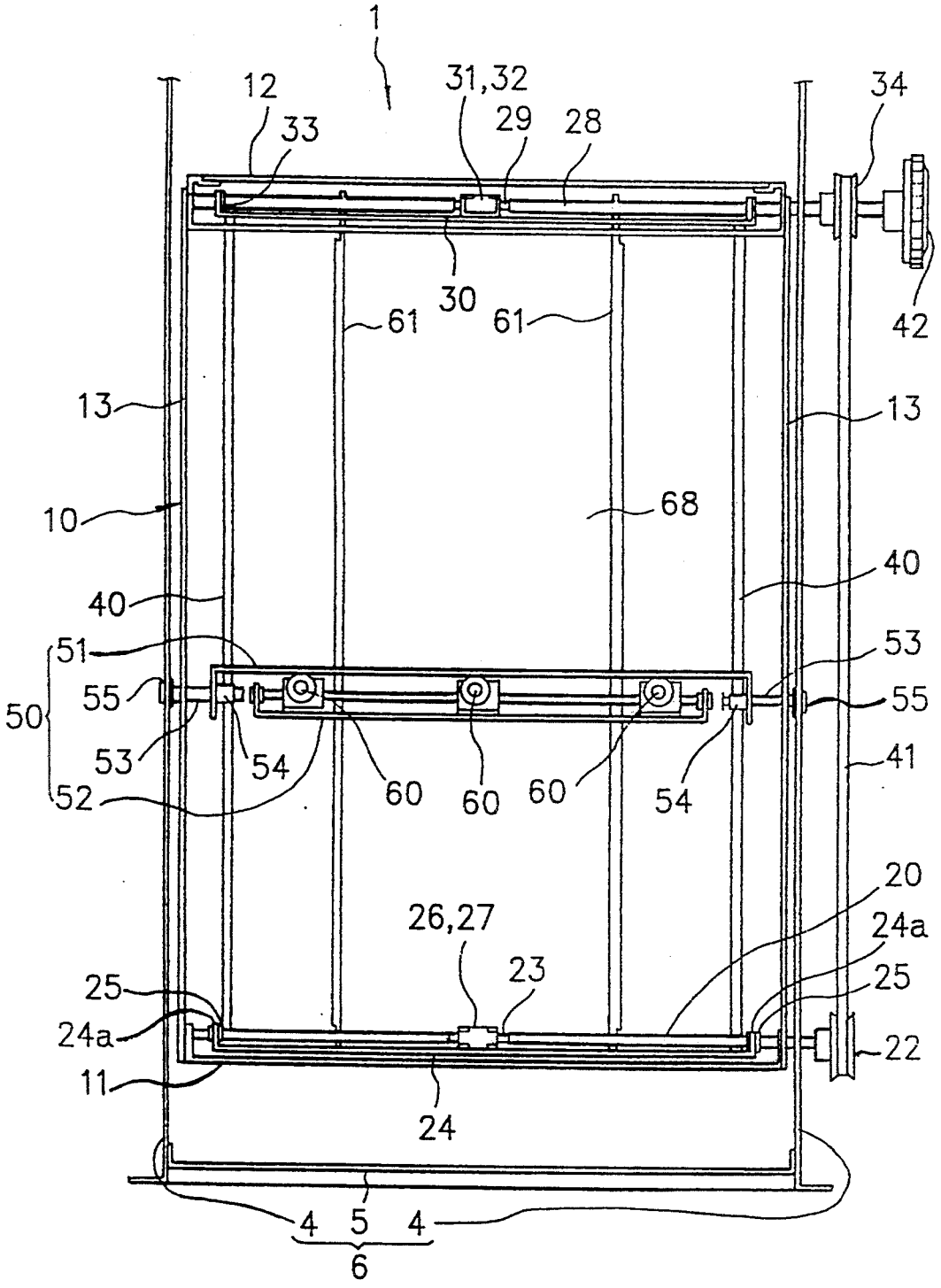
FIG. 3 is a front view of key structures of the embodiment.

As shown in FIGS. 2 and 3, the cut sheet feeder 1 has a substantially box-like frame 6 comprising a right- and a left-hand side plate 4 and a bottom plate 5. The top portions of the side plates 4 and 4 are interconnected fixedly by use of bars 7.

Figure 4:
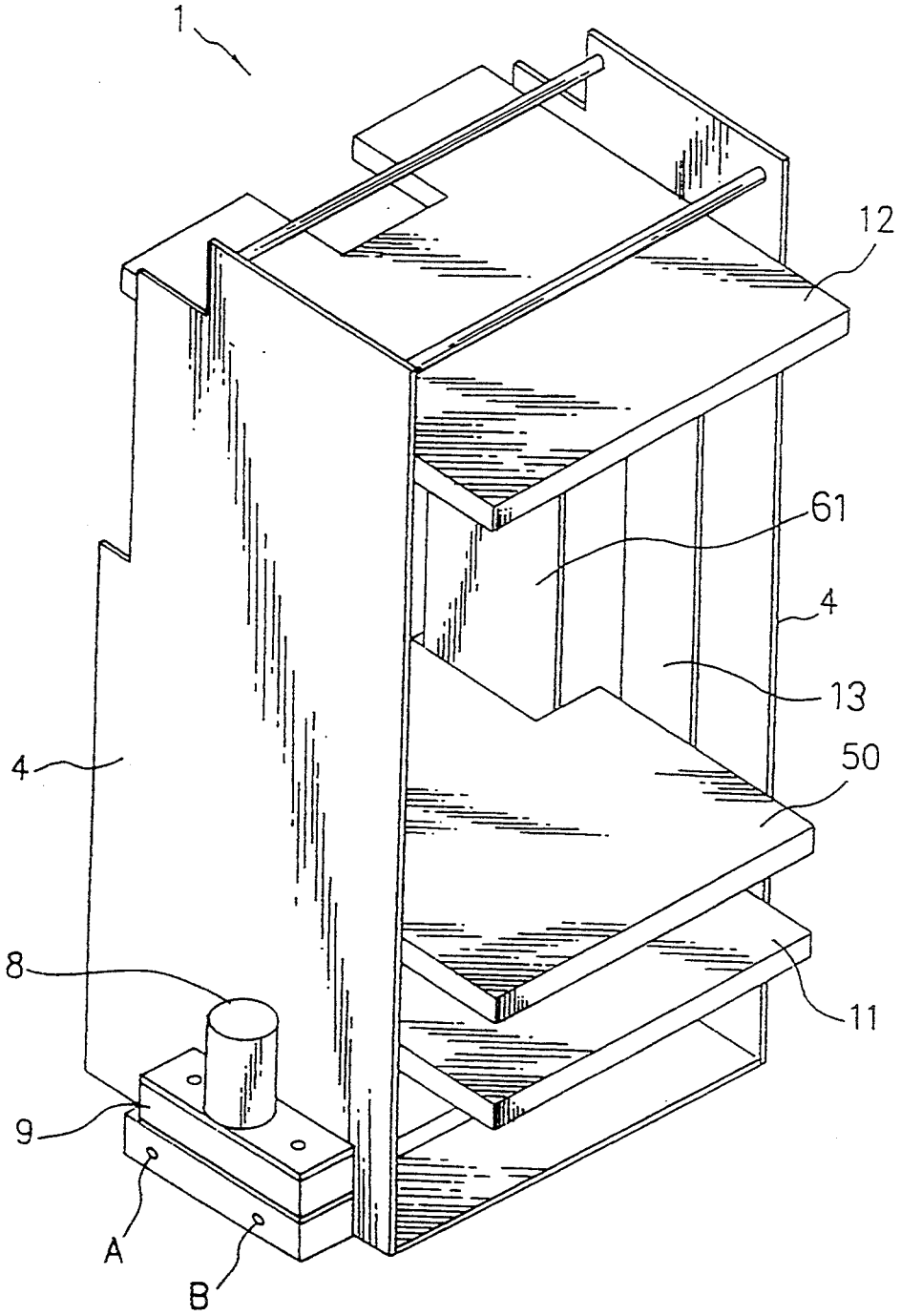
FIG. 4 is a perspective view of a driving source and its associated components of the embodiment.

As depicted in FIG. 4, one side plate 4 has a motor 8 mounted on its outer surface near the bottom, the motor acting as a driving source of the cut sheet feeder 1. The motor 8 is coupled to an input shaft of a gear box 9 comprising reduction gears and clutches. The gear box 9 has two drive shafts A and B provided as its output shafts. The drive shafts A and B are in parallel and set apart from each other by a predetermined distance. The shafts A and B are furnished rotatably across the two side plates 4.

As indicated in FIGS. 2 and 3, a substantially box-like sheet feed unit 10 is furnished in a vertically movable manner inside the frame 6. The sheet feed unit 10 has a bottom plate 11 and a top cassette plate 12, the latter plate 12 serving as a first sheet feed table. The two plates 11 and 12 are coupled by a pair of side plates 13. The top cassette plate 12 has a sheet-containing cassette K placed thereon (see FIG. 7(*b*)). When a large number of cut sheets are to be printed continuously without the use of the cassette K, the cassette K is detached from the top cassette plate 12 and the entire sheet feed unit 10 is set in an upward, appropriate position in a manner to be described later. At this point, the cassette plate 12 is prevented from interfering with the pick-up rollers of the sheet feed mechanism 3. The interference is avoided by furnishing the cassette plate 12 with a cutout portion 14, as indicated in FIGS. 1 and 2.

FIG. 2 shows the frame 6 having vertically parallel guide grooves 15 and 16. A roller 70 attached rotatably to one edge of the bottom plate 11 moves freely up and down along one guide groove 15. Another roller 71 attached rotatably to one edge of the cassette plate 12 moves freely up and down along the other guide groove 16.

A take-up pulley 17 is mounted on the tip of the drive shaft A protruding from the side plate 4. An intermediate pulley 18 is furnished on the side plate 4 and above the guide groove 15. One end of a wire 19 is attached to the circumference of the take-up pulley 17. The wire 19 is engaged around the intermediate pulley 18, and has its other end connected to the roller 70.

As the motor 8 drives the drive shaft A to get the take-up pulley 17 to take up the wire 19, the wire 19 pulls the roller 70 upward. This causes the sheet feed unit 10 to move up along the guide grooves 15 and 16 inside the frame 6. When the drive shaft A is rotated in reverse, the wire 19 is unwound from the take-up pulley 17 to let the sheet feed unit 10 come down by its own weight. In this manner, the box-like sheet feed unit 10 is moved up and down inside the frame 6.

As shown in FIGS. 2 through 5, an adjusting shaft 20 is provided above the bottom plate 11 of the sheet feed unit 10 and in parallel with the drive shafts A and B. The adjusting shaft 20 spans rotatably the side plates 13 of the sheet feed unit 10. One end of the adjusting shaft 20 protrudes from a groove 21 provided vertically along one side plate 4 of the frame 6. The protruding end of the adjusting shaft 20 has a pulley 22 mounted thereon. A thread portion 23 is provided in the middle of the adjusting shaft 20.

Between the bottom plate 11 and the adjusting shaft 20 of the sheet feed unit 10, a lower fence plate 24 is furnished. The adjusting shaft 20 penetrates the edges 24*a* of the lower fence plate 24 through slide bushes 25 interposed between the shaft and the plate edges. The thread portion 23 of the adjusting shaft 20 engages with a thread receiver 27 fixed by fittings 26 to the top of the lower fence plate 24. In this setup, rotating the adjusting shaft 20 causes the lower fence plate 24 to move axially within the sheet feed unit 10.

The above-described mechanism for moving the lower fence plate 24 has its counterpart under the cassette plate 12 of the sheet feed unit 10, as shown in FIG. 3. In the latter mechanism, a thread portion 29 of an adjusting shaft 28 engages with a thread receiver 32 fixed by fittings 31 to an upper fence plate 30. As depicted in FIG. 2, the upper adjusting shaft 28 penetrates a groove 35 provided on the side plate 4. Reference numeral 33 stands for slide bushes, and 34 stands for a pulley. The pulley is fixed to the adjusting shaft 28.

As shown in FIG. 3, the upper fence plate 30 and the lower fence plate 24 are coupled by guide shafts 40. A timing belt 41 is engaged around a pulley 34 of the upper fence plate 30 and around a pulley 22 of the lower fence plate 24. The adjusting shaft 28 of the upper fence plate 30 has a dial 42 for manual operation. The dial 42 when operated allows the adjusting shaft 28 to be rotated manually.

When the upper adjusting shaft 28 is rotated by manually turning the dial 42, the lower adjusting shaft 20 is rotated concurrently by way of the pulleys 34 and 22 and the timing belt 41. The upper and lower fence plates 30 and 24 coupled by the guide shafts 40, with their positions adjustable crosswise inside the sheet feed unit 10, constitute a mechanism for horizontally positioning a sheet feed table 50, to be described later with reference to FIG. 3.

As shown in FIG. 3, the sheet feed unit 10 incorporates the sheet feed table 50 under the cassette plate 12. The sheet feed table 50 is vertically movable and serves as a second sheet feed table. The sheet feed table 50 comprises an upper tray 51 on which a large number of cut sheets are stacked, and a lower tray 52 that movably supports the upper tray 51.

Guide members 54 are furnished on both sides of the upper tray 51. The guide shafts 40 penetrate the guide members 54. The upper tray 51 moves up and down along the guide shafts 40.

As shown in FIGS. 2 and 3, rollers 55 are provided at both ends of support shafts 53 fixed to the lower tray 52. As indicated in FIG. 2, the side plate 4 of the frame 6 has two vertical guide grooves 56 with which the rollers 55 of the support shafts 53 are movably engaged. A take-up pulley 57 is attached to the end of the drive shaft B protruding from the side plate 4. Intermediate pulleys 58 are provided on the side plate 4 above the guide grooves 56. One end of each of two wires 59 is attached to the circumference of the take-up pulley 57. The two wires 59 are engaged respectively around the two different intermediate pulleys 58, and have their other ends attached to the two rollers 55.

When the motor 8 drives the drive shaft B causing the take-up pulley 57 to take up the two wires 59, the wires 59 pull up the rollers 55 and thus lift the lower tray 52 along the guide shafts 40 within the sheet feed unit 10. When the drive shaft B is rotated in reverse, the wires 59 are unwound from the take-up pulley 57 to let the lower tray 52 come down by its own weight.

The side plate 4 opposite to the one shown in FIG. 2 has another identical mechanism for driving the sheet feed unit 10 and the sheet feed table 50 by use of the drive shafts A and B and of the wire and pulley arrangement. This mechanism is omitted in FIG. 4.

As shown in FIG. 3, a plurality of bearings 60 is provided on top of the lower tray 52. These bearings 60 carry the upper tray 51 in a freely movable manner. The upper tray 51 is movable vertically along the guide shafts 40 and horizontally along the support shafts 53. When the dial 42 is manipulated to move the upper and lower fence plates 30 and 24 horizontally, the upper tray 51 of the sheet feed table 50 moves along the support shafts 53.

Figure 5:
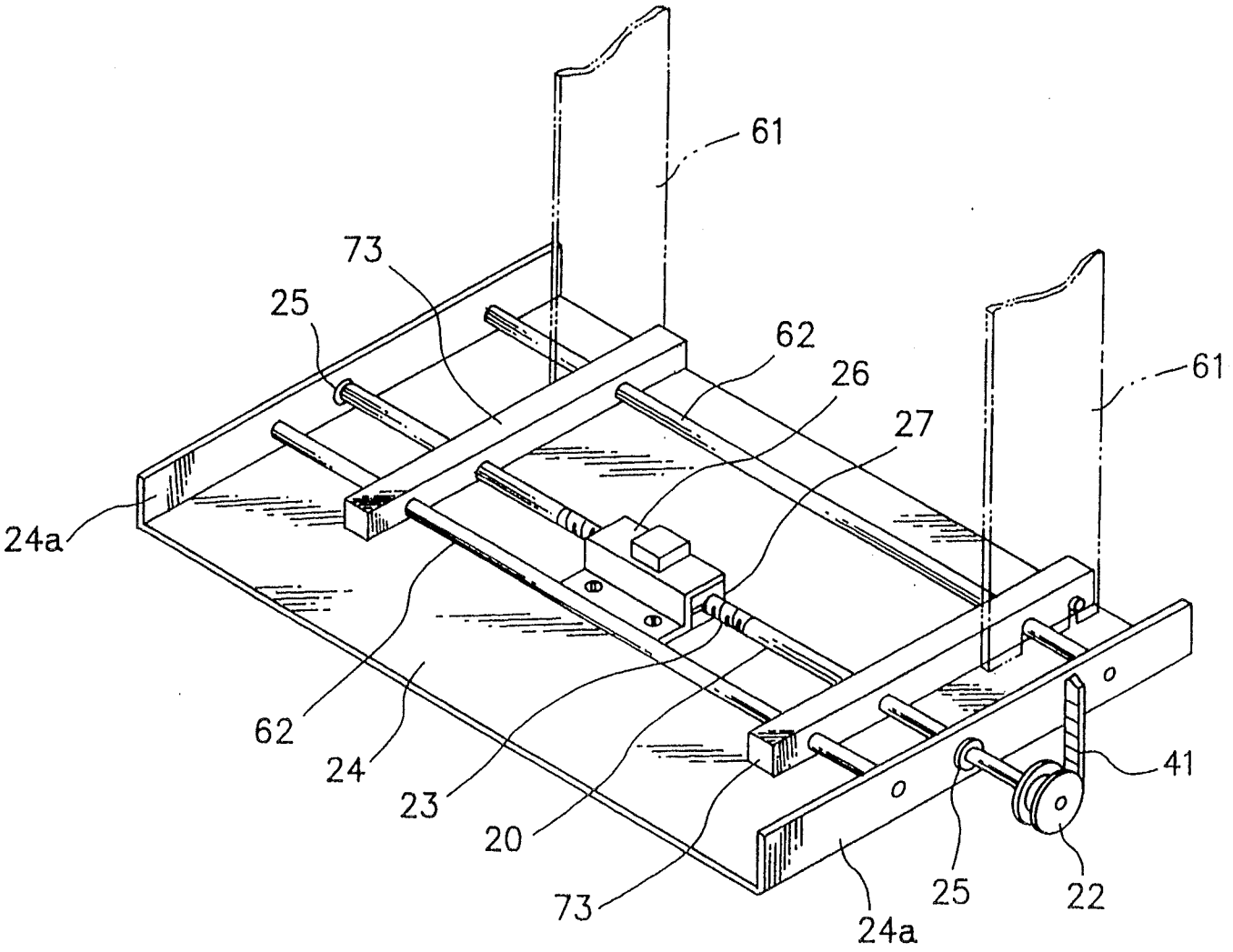
FIG. 5 is a perspective view of a fence adjusting mechanism and its associated components of the embodiment.

As shown in FIGS. 3 through 5, two fences 61 are furnished in a horizontally movable manner between the upper and lower fence plates 30 and 24. As depicted in FIG. 5, sliders 73 are mounted slidingly on two parallel guide shafts 62 fixed to the lower fence plate 24. The lower portions of the fences 61 are fixed to the sliders 73 so that the fences 61 may be moved together with the sliders 73 along the guide shafts 62. Although not shown, the same mechanism is provided above the upper fence plate 30 and the fences 61. Fittings, also not shown, are provided to secure the fences 61 in position.

Figure 6A:
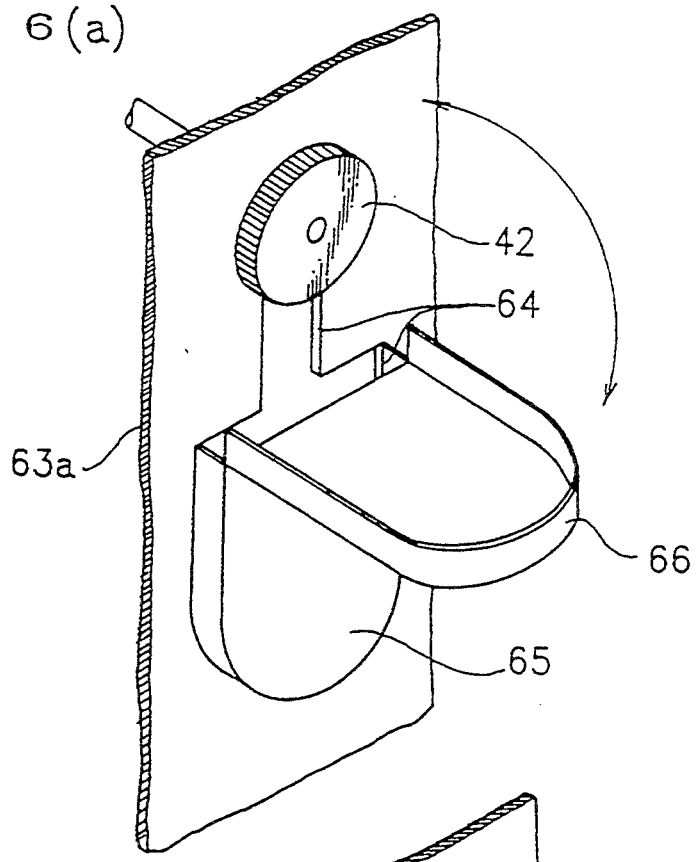
FIGS. 6(*a*) and 6(*b*) are perspective views showing dial movements of the embodiment.
Figure 6B:
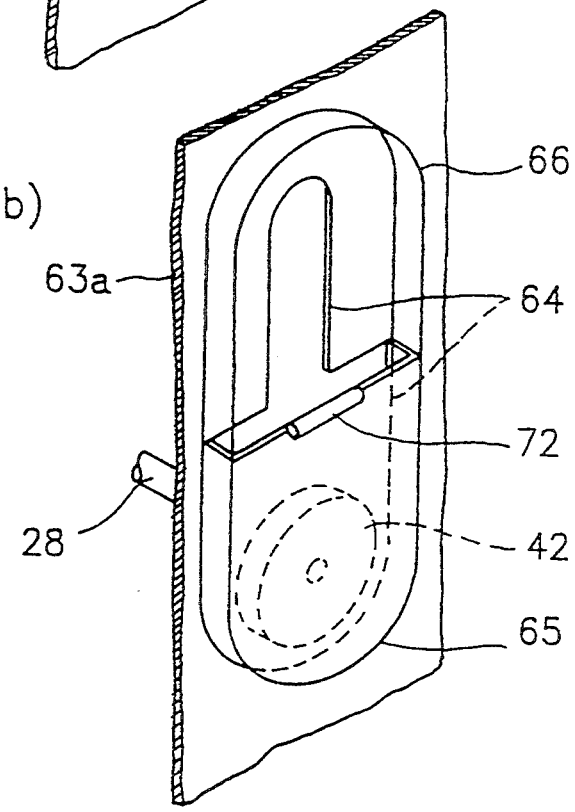

Comparing FIG. 1 with FIG. 2 reveals that the mechanisms outside the side plates 4 are protected by covers 63*a* and 63*b*. As shown in FIGS. 6(*a*) and 6(*b*) the cover 63*a* on the one side has an approximately embossed opening portion 64 having a narrow part and a wide part. The narrow part of the opening portion corresponds to the diameter of the adjusting shaft 28 so that the shaft 28 may move vertically therein. The wide part of the opening portion corresponds to the diameter of the dial 42 so that the cover 63*a* may be detached from the cut sheet feeder 1 with the dial 42 left mounted on the adjusting shaft 28. The narrow and the wide part of the opening portion 64 are covered with lids 65 and 66 which constitute an outwardly embossed space for accommodating the dial 42. The lid 65 is formed integrally with the cover 63*a*. The lid 66 is formed by a transparent or translucent material and is attached swingingly to the lid 65 by use of a hinge 72.

Figure 7:
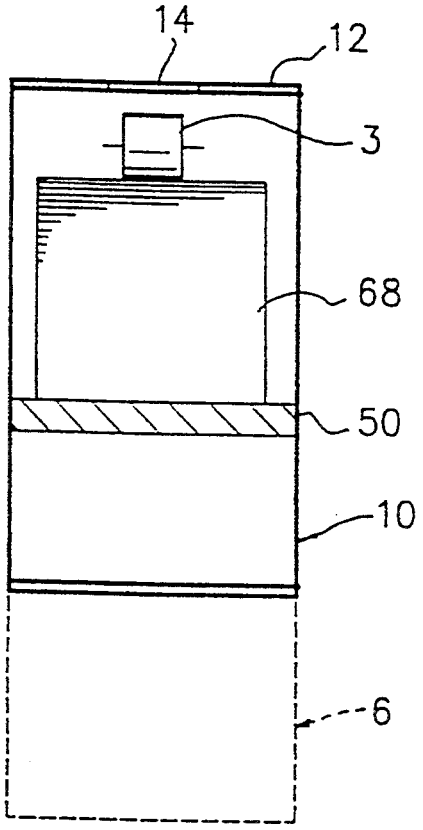
FIG. 7(*a*) is a schematic view of the embodiment set for bulk printing using the sheet feed table.
Figure 7:
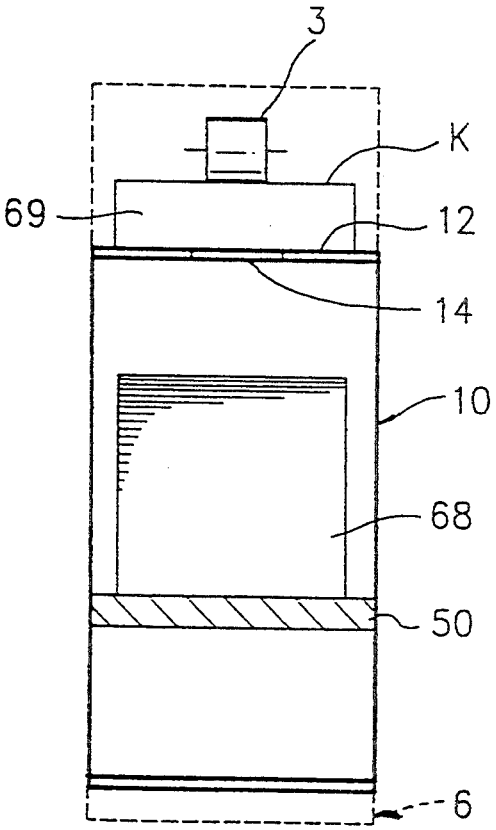
Figure 8A:
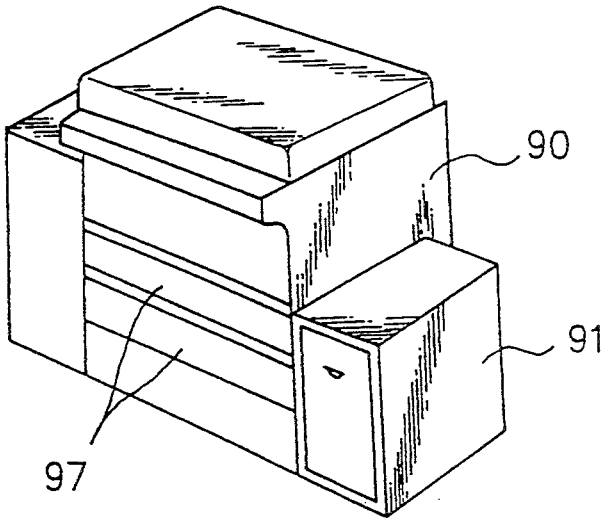
FIG. 8(*a*) is a perspective view of a conventional image forming apparatus equipped with a conventional cut sheet feeder.
Figure 8B:
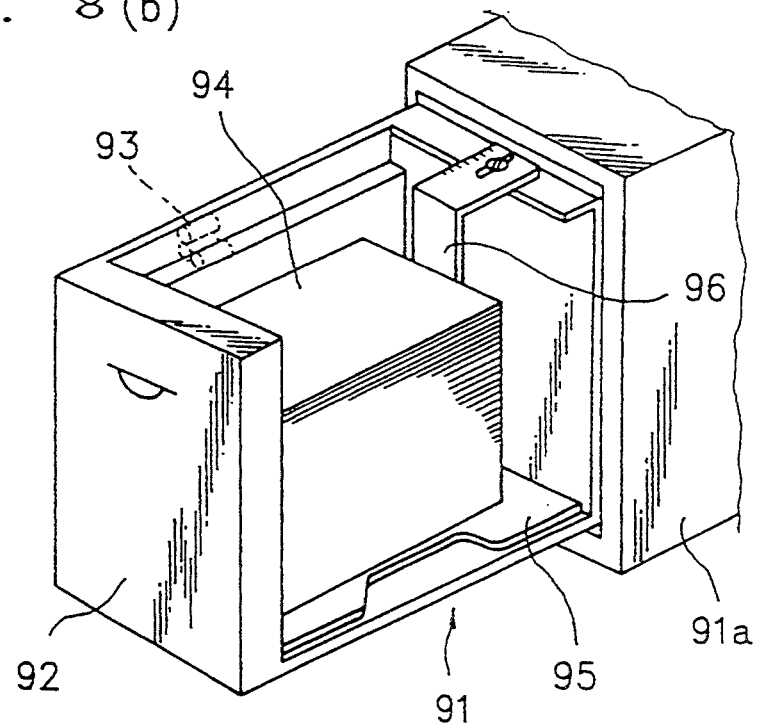

A mode changeover switch, not shown, may be used to select a table feed mode for bulk printing. With the table feed mode in effect, the sheet feed unit 10 is raised as shown in FIG. 7(*a*) so that the cut sheets on the sheet feed table 50 will be positioned under the sheet feed mechanism 3 (for bulk sheet feed operation). In this state, the dial 42 is positioned in the narrow part of the opening portion 64 as depicted in FIG. 6(*a*). This leaves the dial 42 visible through the transparent lid 66. Opening the lid 66 allows the dial 42 to be operated manually. The mode changeover switch, not shown, may also be used to select a cassette feed mode. In this mode, the sheet feed unit 10 is lowered as shown in FIG. 7(*b*) so that the cut sheets in the cassette K will be positioned under the sheet feed mechanism 3 (for cassette-based feed operation). This positions the dial 42 in the wide part of the opening portion 64 and hides the dial 42 behind the lid 65 as shown in FIG. 6(*b*).

At the front of the cut sheet feeder 1 is a cover 67 installed swingingly, as shown in FIG. 1. Arrangements are made so that if the cover 67 is left open, the moving parts will not be driven or moved up or down. This ensures the operator's safety upon operation.

With the above setup, suppose that a large number of cut sheets are desired to be printed continuously in the table feed mode. In that case, without the cassette K mounted on the cassette plate 12, the sheet feed unit 10 is lifted so that the cassette plate 12 will be positioned above the sheet feed mechanism 3, as shown in FIG. 7(*a*). The cutout portion 14 of the cassette plate 12 allows the entire sheet feed unit 10 including the plate 12 to go up without interference with the sheet feed mechanism 3. The sheet feed unit 10 is then positioned so that the pick-up rollers of the sheet feed mechanism 3 will come into contact, at a predetermined contact pressure, with the top of the cut sheets 68 stacked on the sheet feed table 50. After printing is started, the sheet feed mechanism 3 picks up the cut sheets 68 one by one and feeds them into the printing machine 2. As the stacked cut sheets 68 are being exhausted, the take-up pulley 57 takes up the wires 59 to compensate for the space vacated by the sheets having been fed, whereby the sheet feed table 50 is lifted correspondingly.

In the table feed mode for bulk printing, the dial 42 is positioned upward where it may be operated manually. Manipulating the dial 42 finely adjusts the crosswise positions of the upper and lower fence plates 30 and 24 as that well as of the upper tray 51 on the sheet feed table 50 relative to the cut sheets 68.

Suppose that cut sheets are desired to be fed from the cassette halfway through bulk printing in the table feed mode. In that case, the cassette feed mode is first selected, and the sheet feed unit 10 is lowered as shown in FIG. 7(*b*) so that the cassette plate 12 will be positioned under the sheet feed mechanism 3. This time, too, the sheet feed mechanism 3 goes through the cutout portion 14 without interference with the cassette plate 12. The cassette K containing cut sheets 69 is mounted on the cassette plate 12. As shown in FIG. 7(*b*), the sheet feed unit 10 is positioned so that the pick-up rollers of the sheet feed mechanism 3 will come into contact, at a predetermined contact pressure, with the top surface of the cut sheets 69 in the cassette K. The sheet feed mechanism 3 then starts feeding the sheets from the cassette.

In the cassette feed mode, the dial 42 is hidden behind the lid 65 and will not be accessed even if the lid 66 is opened. That is, during the cassette-based feed operation carried out on demand halfway through bulk printing, the preset position of the sheet feed plate 50 is not disturbed inadvertently.

In the above-described embodiment, the sheet feed mechanism 3 is a component of the printing machine 2. Alternatively, the sheet feed mechanism 3 may be furnished in the cut sheet feeder 1.

In the above embodiment, the first sheet feed table is used as the plate for accommodating a cassette, and the second sheet feed table as the plate having a large number of cut sheets stacked thereon. Alternatively, the two sheet feed tables may both be used as the plates for accommodating cassettes. Another alternative is to furnish the first sheet feed table with position adjustable fences for aligning the edge positions of cut sheets so that cut sheets of a desired size may be placed directly (i.e., without using a cassette) on the first sheet feed table.

The above embodiment comprises two plates, one for accommodating the cassette and the other for having cut sheets stacked directly thereon. Alternatively, there may be three or more plates provided. In that case, each of the sheet feed tables (including the first sheet feed table) except the lowest sheet feed table (i.e., the second sheet feed table) should include a cutout portion similar to the cutout portion 14 of the cassette plate 12.

As described, the cut sheet feeder according to the invention accommodates a plurality of vertically movable sheet feed tables, and allows any one of the tables to be positioned selectively relative to a single sheet feed mechanism for sheet feed operation from the selected table to the mechanism. The cut sheets on one of the multiple tables may be picked up selectively by one sheet feed mechanism and fed into the image recording portion of the image forming apparatus.

Because the single sheet feed mechanism feeds cut sheets selectively from one of the sheet feed tables into the image recording portion, the sheet transport route remains unchanged from the sheet feed mechanism to the image recording portion. The sheet feed timing is thus kept constant so as to eliminate the need for conventional devices of adjustments to keep constant the timing of feeding cut sheets to the image forming portion. This is particularly effective in improving the print quality of mimeograph printing machines wherein a slight deviation in sheet feed timing can result in the longitudinal misalignment of printed contents.

The fact that the single sheet feed mechanism feeds cut sheets selectively from one of the sheet feed tables into the image recording portion offers another benefit. That is, the structure of the sheet transport route is simplified and this route is easier to maintain than conventional sheet transport routes. With the simply structured sheet transport route taking up less space, the cut sheet feeder as a whole may be manufactured smaller than ever before.

According to the invention, the sheet feed unit vertically movable relative to the sheet feed mechanism has the first sheet feed table for accommodating a cassette, and the second sheet feed table for having cut sheets stacked thereon. The two fences on the second sheet feed table for aligning the edge positions of the cut sheets on the table are included within the sheet feed unit. This ensures a sufficient space to handle and accommodate the cassette. Cassettes are switched on the cassette accommodating plate depending on the desired size of cut sheets. The size of cut sheets may also be changed as desired on the sheet feed table for bulk printing.

In other words, the edge positions of cut sheets in any of different sizes are aligned by the two fences on the second sheet feed table. The fences are contained inside the sheet feed unit and thus have no relevance to the cut sheets on the first sheet feed table. That is, the cut sheets of a given size on the first sheet feed table may be replaced by those of another size irrespective of the size of the cut sheets on the second sheet feed table.

As many apparently different embodiments of this invention may be made without departing from the spirit and scope thereof, it is to be understood that the invention is not limited to the specific embodiments thereof except as defined in the appended claims.

What is claimed is:

1. A cut sheet feeder for use with an image forming apparatus, comprising:

a sheet feed mechanism for picking up one sheet at a time from stacked cut sheets at a predetermined position and for feeding each sheet to an image recording portion of the image forming apparatus;

a sheet feed unit vertically movable relative to said sheet feed mechanism and including a first sheet feed table located in an upper part of said sheet feed unit and including a cutout portion for avoiding interference with said sheet feed mechanism when said first sheet feed table moves vertically in combination with said sheet feed unit; and, a second sheet feed table located in a lower part of said sheet feed unit and vertically movable relative to said sheet feed unit.

2. A cut sheet feeder for use with an image forming apparatus, comprising:

a sheet feed mechanism for picking up one sheet at a time from stacked cut sheets at a predetermined position and for feeding each sheet to an image recording portion of the image forming apparatus;

a sheet feed unit vertically movable relative to said sheet feed mechanism and including a cassette plate, said cassette plate being located in an upper part of said sheet feed unit, and including a cutout portion for avoiding interference with said sheet feed mechanism when moving vertically in combination with said sheet feed unit;

a cassette detachably situated on the cassette plate and containing cut sheets therein; and a sheet feed table located in a lower part of said sheet feed unit and vertically movable relative to said sheet feed unit, said sheet feed table accommodating more cut sheets than said cassette thereon.

3. A cut sheet feeder for use with an image forming apparatus according to claim 2, wherein a position of said sheet feed table is horizontally adjustable.

4. A cut sheet feeder for use with an image forming apparatus according to claim 3 further comprising:

an operation part disposed on said sheet feed unit, said operation part being used to adjust the horizontal position of said sheet feed table, and a cover employed to cover said operation part when the cut sheets are fed from said cassette plate and to expose said operation part when the cut sheets are fed from said sheet feed table.

5. A cut sheet feeder for use with an image forming apparatus, comprising:

a sheet feed mechanism for picking up one sheet at a time from stacked cut sheets at a predetermined position and for feeding each sheet to an image recording portion of the image forming apparatus;

a sheet feed unit vertically movable relative to said sheet feed mechanism; and including a first sheet feed table, said first sheet feed table being located in an upper part of said sheet feed unit and including a cutout portion for avoiding interference with said sheet feed mechanism when said first sheet feed table moves vertically in combination with said sheet feed unit;

a second sheet feed table located under said first sheet feed table and vertically movable within said sheet feed unit; and a pair of fences furnished inside said sheet feed unit for aligning edge positions of cut sheets placed on said second sheet feed table.

6. A cut sheet feeder for use with an image forming apparatus, comprising:

a sheet feed mechanism for picking up one sheet at a time from stacked cut sheets at a predetermined position and for feeding each sheet to an image recording portion of the image forming apparatus;

a sheet feed unit vertically movable relative to the sheet feed mechanism and including a first sheet feed table, said first sheet feed table being located in an upper part of said sheet feed unit and having a cutout portion for avoiding interference with said sheet feed mechanism when moving vertically in combination with said sheet feed unit relative to said sheet feed mechanism;

a cassette detachably situated on the first sheet feed table and containing cut sheets therein;

a second sheet feed table located under said first sheet feed table to be vertically movable inside said sheet feed unit, said second sheet feed table accommodating cut sheets on top thereof; and a pair of fences attached to said sheet feed unit to be adjustable depending on a size of the cut sheets placed on said second sheet feed table, said fences aligning edge positions of said cut sheet.

* * * * *